US005674053A

United States Patent [19]

Paul et al.

[11] Patent Number: 5,674,053

[45] Date of Patent: Oct. 7, 1997

[54] HIGH PRESSURE COMPRESSOR WITH CONTROLLED COOLING DURING THE COMPRESSION PHASE

[76] Inventors: Marius A. Paul; Ana Paul, both of 20410 Via Canarias, Yorba Linda, Calif. 92686

[21] Appl. No.: 664,796

[22] Filed: Jun. 17, 1996

Related U.S. Application Data

[63] Continuation of Ser. No. 303,617, Dec. 8, 1994, abandoned, which is a continuation-in-part of Ser. No. 222,661, Apr. 1, 1994, abandoned.

[51] Int. Cl.[6] ..... F04B 39/04

[52] U.S. Cl. ..... 417/228; 417/243; 417/274; 62/50.2; 62/505

[58] Field of Search ..... 417/228, 250, 417/254, 258, 243, 274; 60/659, 650, 648; 62/50.2, 50.7, 39, 505

[56] References Cited

U.S. PATENT DOCUMENTS

| | | | |
|---|---|---|---|
| 1,872,932 | 8/1932 | Goldsbororough | 417/228 |
| 1,967,935 | 7/1934 | Herzmark | 417/254 |
| 2,082,189 | 6/1937 | Twomey | 62/50.2 |
| 2,090,163 | 8/1937 | Twomey | 62/50.2 |
| 2,423,677 | 7/1947 | Balogh | 417/274 |
| 2,577,107 | 12/1951 | Cooper | 62/505 |
| 3,070,966 | 1/1963 | Ruhfmann et al. . | |
| 3,088,656 | 5/1963 | Hartley | 417/274 |
| 3,195,316 | 7/1965 | Maher et al. | 62/50.2 |
| 3,503,220 | 3/1970 | Desai | 62/39 |
| 3,690,114 | 9/1972 | Swearingen et al. . | |
| 3,724,226 | 4/1973 | Pachaly | 62/39 |
| 3,735,600 | 5/1973 | Dowdell et al. | 62/39 |
| 4,100,745 | 7/1978 | Gyarmathy et al. | 62/659 |
| 4,276,749 | 7/1981 | Crowley | 62/50.2 |
| 4,791,787 | 12/1988 | Paul et al. . | |
| 4,809,646 | 3/1989 | Paul et al. . | |
| 4,843,813 | 7/1989 | Paul et al. . | |
| 4,878,355 | 11/1989 | Beckey et al. | 62/505 |
| 4,936,262 | 6/1990 | Paul et al. . | |
| 4,948,404 | 8/1990 | Delong | 62/39 |
| 4,974,427 | 12/1990 | Diab | 62/505 |
| 4,995,234 | 2/1991 | Kooy et al. | 62/659 |
| 5,140,828 | 8/1992 | Hagita | 62/505 |
| 5,409,046 | 4/1995 | Swenson et al. | 62/50.2 |

FOREIGN PATENT DOCUMENTS

| | | | |
|---|---|---|---|
| 402247469 | 10/1990 | Japan | 62/505 |
| 405026399 | 2/1993 | Japan | 62/50.7 |
| 405280696 | 10/1993 | Japan | 62/50.7 |
| 93/24754 | 12/1993 | WIPO | 417/228 |

*Primary Examiner*—Michael Koczo
*Assistant Examiner*—Ted Kim
*Attorney, Agent, or Firm*—Bielen, Peterson & Lampe

[57] ABSTRACT

A high pressure gas compressor in one embodiment having an internal two staged compression with a compression chamber formed in part by a positive displacement, stepped piston and cylinder configuration, providing a first stage compression by an enlarged diameter segment of the piston and a second stage compression provided by a smaller diameter segment of the piston, and in another embodiment having an internal, single stage compression with a high compression ratio. Temperature is maintained within design limits by the admission to the compression chamber of an expanded gas from a high pressure storage, which on adiabatic expansion of the admission gas reduces the temperature of the mixed charge for final compression at a resultant temperature that is within the design limits of the compressor unit in one embodiment and by the initial expansion of a residual gas mixed with a compression charge initially, followed by an injection of liquified gas during compression to achieve substantially isothermal compression with the finally compressed gas having an ambient temperature.

5 Claims, 12 Drawing Sheets

22
24
26
14
136
32
46
44
70
28
36
50
48
80
64
58a
56
54
102
T
66a
74
76
TS
20
52
62
142
60
98
66b
68
64b
58b
18
140
78
116
122
120
118
138
16
10
100
104

HIGH PRESSURE COMPRESSOR WITH CONTROLLED COOLING DURING THE COMPRESSION PHASE

This is a continuation, of application Ser. No 08/303,617, filed 8 Dec. 1994, now abandoned which is a continuation-in-part of our application, Ser. No. 08/222,661, now abandoned filed 1 Apr. 1994 of the same title.

BACKGROUND OF THE INVENTION

This invention relates to a high pressure, high volume gas compressor. The gas compressor of the invented design includes multiple first embodiments that incorporate a common design feature for integrating high compression of a mixed gas charge by one or more stages in a single unit. In a second embodiment, a single design feature of a stage compressor unit includes liquified gas injection as a secondary compressed charge coolant. The compressor units may be operated in conjunction with a precompressor, or pressurized gas source for delivery of pressurized gas to the compressor units. Additionally, the compressor units may be operated in conjunction with an energy recovery expander for recovery of work from the expansion of pressurized gas that is featured in all compressor units for production of high pressure delivered gas at an operational temperature that does not adversely effect the internal components of the compressor unit.

High pressure compression of gases by positive displacement compressors is customarily done in stages. After each compression stage, the gas is delivered to an intercooler to reduce the temperature of the compressed gas. Heretofore, single stage compression to a level utilized by many commercial enterprises for compact storage has not been possible, since the initial high temperature of the compressed gas may adversely effect the structural components of the compressor. For example, a single stage compression of a gas at ambient pressures to 4000 psi would result in a gas temperature of over 600° C. This temperature exceeds the desired operating temperature of valves, seals, and other thermally sensitive components in the compressor. In order to avoid the use of exotic materials, it is desirable to maintain the gas charge at substantially lower temperatures. Where it is desired to compress a gas in one stage with pressure ratios of 30, 40, or 80 to 1, excessive gas temperature has been a barrier to single stage compression. Conventional, high pressure, multi-stage compressors are usually equipped with a piston having an enlarged cross-head mechanism to absorb the side thrust produced by the angular variation of the connecting rod. The side force of the piston against the cylinder wall is a major source of friction and the use of a stabilizing cross-head configuration adds length to the required axis for the compressor cylinder and adds complimentary weight and cost. Additionally, the use of standard piston ring arrangements in a positive-displacement, piston-type compressor, contributes to wall friction in the cylinder, because of the infiltration of high pressure gas behind the rings. The infiltrated gas increases contact pressure between the piston rings and the cylinder liner. This contact pressure contributes measurably to the friction of the piston assembly with the cylinder liner and results in excessive wear and high energy consumption. These problems coupled with the fundamental problems of multi-staged intercooling adds to the complexity and costs of existing systems for compression of air, natural gas, carbon dioxide and other gases.

SUMMARY OF THE INVENTION

The gas compressor unit of this invention is a positive-displacement piston compressor that is designed to operate at high compression ratios to compress air and other gases such as natural gas. The compressor unit is designed to accomplish in a single stage, that which is conventionally accomplished in multi-stages with an intercooler component between each stage. The compressor unit can be utilized in conjunction with a precompressed source of gas from a high volume precompressor or a pressurized gas supply line to supply pressurized gas to the compression unit for compression.

In general, the compressor unit of this invention is designed to utilize a gas supply at ambient temperature and to compress the gas at very high pressures, while maintaining the resultant temperature of the compressed gas within design limits of the compressor. Importantly, the compressor unit includes a temperature control system that can monitor and adjust the temperature of the compressed discharged gas to maintain the gas temperature within the design limits.

In practice, the compressor unit operates as an intermediate unit between a gas supply at ambient temperature and a high pressure gas storage, also maintained at ambient temperature. While the temperature of the gas source and gas storage may vary from ambient temperatures, such variations will affect the efficiency of the gas compression system, which depends in substantial part on the temperature drop of a charge of pressurized gas during adiabatic expansion. Since the system includes temperature monitoring and regulation, these adjustments can be automatically performed during operation.

In connection with the description of the preferred embodiments, an ambient temperature gas supply and an ambient temperature pressurized gas storage will be utilized to establish reference examples for compression of gas to 4000 psi, a high pressure objective. Substantially higher pressures are achievable by the systems provided.

In the systems disclosed, the compressor unit utilizes certain features that are common to engine technologies devised by the inventors herein U.S. patents entitled, REGENERATIVE THERMAL ENGINE, U.S. Pat. No. 4,791,787, issued Dec. 20, 1988 and U.S. Pat. No. 4,936,262, issued Jun. 26, 1990, describe configurations for system and cylinder arrangements having dual connecting rods for elimination of side forces. U.S. Pat. entitled, HIGH PRESSURE RECIPROCATOR COMPONENTS, U.S. Pat. No. 4,809,646 issued Mar. 7, 1989, describes a wrist pin configuration for. connecting rods and high pressure sealing rings for pistons. U.S. application, Ser. No. 08/054,050, filed Apr. 26, 1993 entitled, INTEGRATED THERMAL-ELECTRIC ENGINE describes a stepped piston configuration.

The compressor unit in one set of embodiments of this invention utilizes a reciprocating piston having a piston with a cross-head style configuration in which the enlarged diameter portion of the piston initiates an integrated first stage of compression of a supply gas that is subsequently delivered to a smaller diameter, high pressure segment for final compression. This integrated two-step compression allows for high volumetric efficiency and compensates for minor volumetric losses that are the result of the introduction of a precharge of adiabatically expanded gas into the high pressure compression chamber. The added charge of adiabatically expanded gas is key to maintenance of the controlled compression temperature for the resultant pressurized gas delivered from the system to storage. Each of the embodiments of the compressor units described in the detailed description incorporate the controlled regulation of expansion gases to moderate the resultant temperature of the compressed gases to be well within the thermal design specifications of the compressor unit. In a second type of embodiment where a single stage of compression is employed, thermal conditions are regulated by injection of liquified gas that upon gassification and expansion provides a second stage of cooling during compression. As the supply of expansion gas is closely regulated by an electronically controlled return valve, adjustments are continually made during operation of the compressor unit for maintaining the optimum efficiency of the system according to the demand and the environmental conditions during operation.

The two-stage integrated compression within certain embodiments of the compressor unit occurs concurrently, such that the wide diameter precompression segment of the piston compresses gas to a first stage that is sequentially compressed by the smaller segment piston on the next stroke in the second stage, high pressure portion of the compressor assembly. In the first or second stage, the supply charge of gas is mixed with a controlled supply of expanded gas from the high pressure gas storage. The expanded gas charge quickly reduces the temperature of the gas mix resulting in a substantially lowered delivery temperature of the finally compressed, high pressure gas. As mentioned, this resulting temperature can be adjusted by careful control of the quantity of expanded gas introduced into the compression cylinder.

In other embodiments where the gas is already under high pressure during compression, the cooling gas is injected as a liquid using fuel injection technologies to overcome internal cylinder pressures of the compressing gas during later phases of the compression stroke. Careful control of the quantities, duration and timing of injected liquified gas enables regulation of the resultant temperature of the compressed gas.

DETAILED DESCRIPTION OF THE PREFERRED EMBODIMENTS

Figure 1:
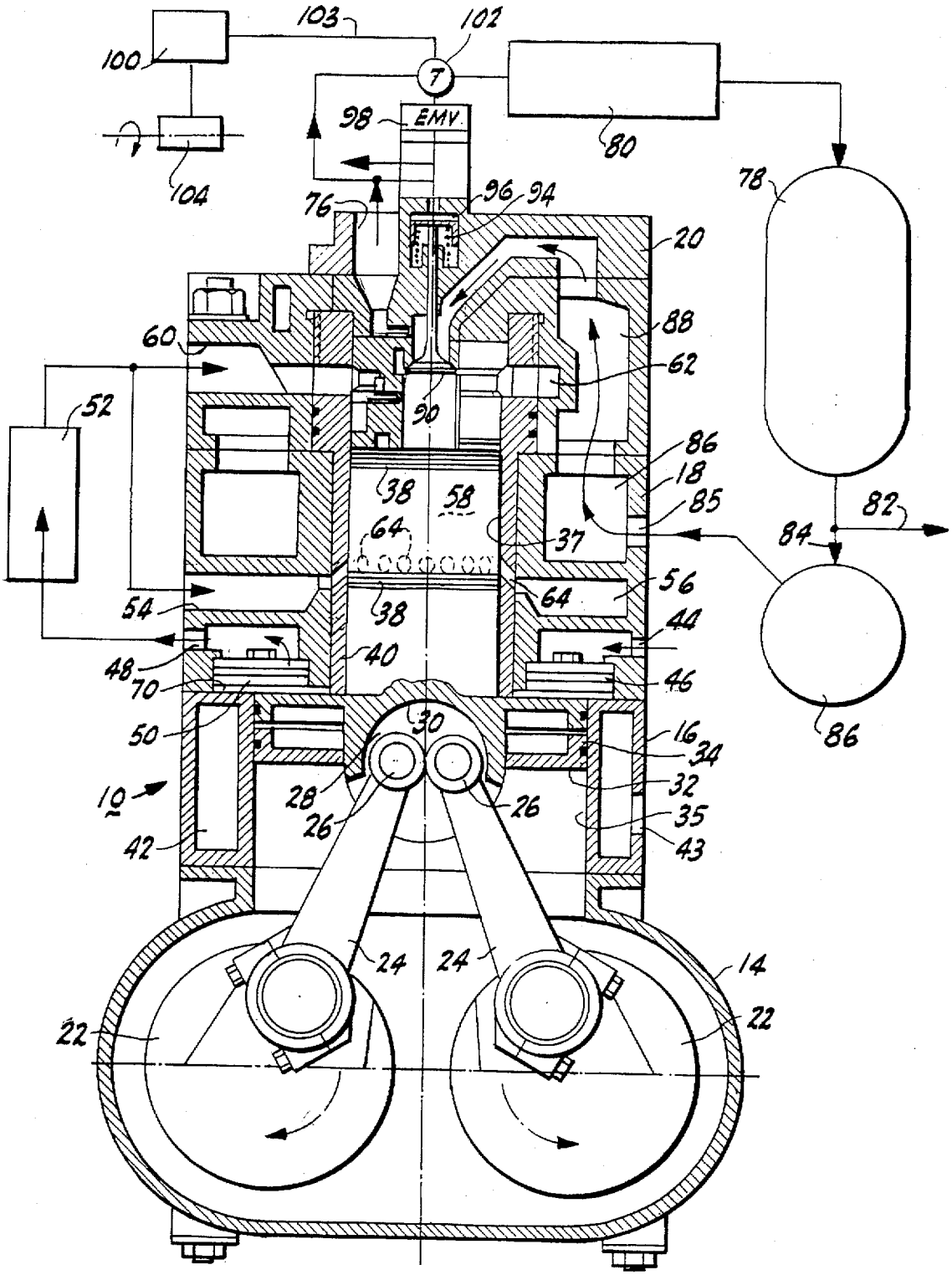
FIG. 1 is a cross-sectional, elevational view of the compressor unit with auxiliary components shown schematically.

Referring to the drawings, the compressor unit is generally identified by the reference numeral 10. Many of the elements of the compressor unit in each of the embodiments are identical and are identified by the same reference numeral for ease of cross reference. It is to be understood that other modifications can be incorporated into the systems disclosed without departing from the unique concepts and features embodied in the preferred embodiments described.

Figure 2:
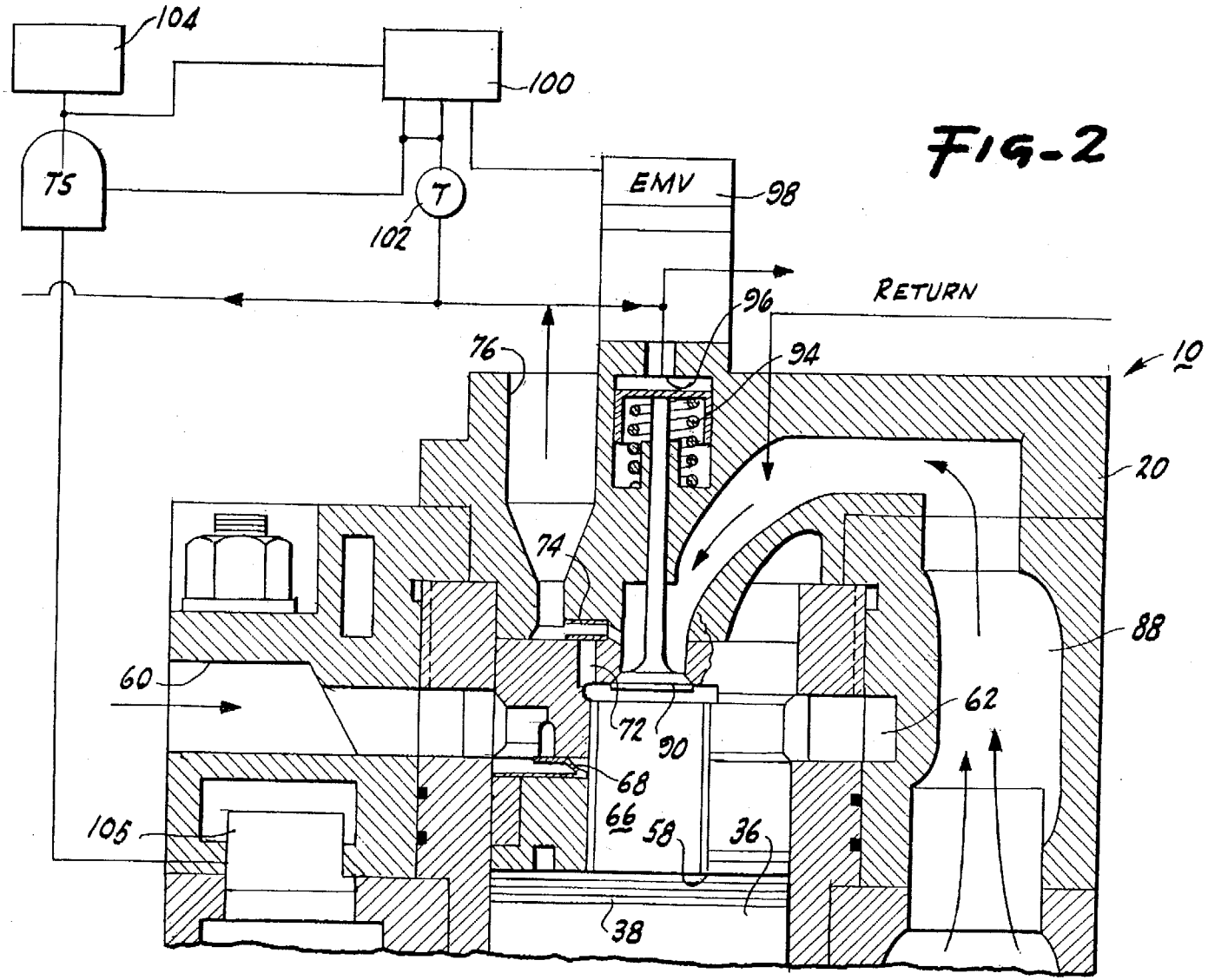
FIG. 2 is an enlarged partial view of the compressor head in the compressor unit of FIG. 1.

Referring to FIGS. 1 and 2, the compressor unit 10 includes a housing 12 that is comprised of a crank case 14 coupled to a low-pressure-stage, cylinder block 16. The low-pressure-stage, cylinder block 16 is in turn coupled to a high-pressure-stage, cylinder block 18 that is capped by a cylinder head 20.

The crank case 14 houses two counter rotating crankshafts 22 that are connected to dual connecting rods 24 having wrist pins 26 fixed to their distal end that articulate in mutual rolling contact in a spherical bearing 28. The spherical bearing 28 is trapped in a bearing housing 30 in the underside of a stepped piston 32. The stepped piston 32 has a large diameter segment 34 that reciprocates in the cylinder 35 of the low-pressure-stage, cylinder block 16 and a small diameter segment 36 that reciprocates in the cylinder 37 high-pressure-stage, cylinder block 18. The small diameter segment 36 of the stepped piston 32 includes an upper and lower set of piston rings 38. At least the upper piston rings at the distal end of the stepped piston are of the high pressure type as disclosed in the referenced patent to insure that the high pressure gases of the finally compressed gas does not leak behind the piston rings and force them against the piston liner 40 that forms the wall of the chamber 58 for the high-pressure-stage compression.

In the embodiment of FIG. 1, the low pressure stage cylinder block 16 includes a cooling plenum 42 that has an access passage 43 for auxiliary cooling by a cooling fluid or gas, if desired. During the retraction stroke of the stepped piston 32, a supply charge of gas at ambient temperature enters through a port 44 protected by an automatic, one-way wafer valve 46 that allows entry but not exhaust of the gas charge. A similar exit port 48 is protected by a similar wafer valve 50 that allows the gas charge to pass through the exit port 50 upon the compression stroke of the piston 32. Since only the large diameter segment 34 of the stepped piston 32 acts on the intake gas charge, the diameter of the piston is sized to provide the desired first stage compression with the required volume to provide the necessary charge for the high-pressure-stage compression.

In the embodiment of FIG. 1, a suitable intercooler 52 that is externally mounted proximate the high-pressure-stage, cylinder block 18 cools the compressed gas and the gas to a first gas intake 54 that supplies a plenum 56 around that lower portion of the chamber 58 formed by the cylinder liner 40 and the retracted small diameter segment 36 of the stepped piston 32, and, a gas intake 60 that supplies a second plenum 62 at the top of the chamber 58. Gas enters the chamber 58 through a series of circumferential ports 64 (shown in dotted line) which are exposed when the small diameter segment 36 of the stepped piston 32 is retracted, and through a passage 65 protecting by a flap valve 68 leading to a volumetric chamber 66 for pressurized gas. The dual entry for charging the high-pressure-stage chamber 58, shown in greater detail in FIG. 2, allows for rapid charging and dispersion of gases from the low pressure compression chamber 70 to the volumetric chamber 66 and high-pressure-stage chamber 58. This charge is mixed with a charge of expansion gas that has an important cooling effect as described hereinafter. Highly compressed gases exit through a small passage 72 that is also protected by an automatic flap valve 74 for entry into the exit passage 76 for supply to a high pressure storage receiver 78.

Because operation of this cycle generates pressurized gases at high temperature, maximum pressures can be achieved using system components of conventional material expansion circuit that expansion circuit that is operated concurrently with the operation of the compression cycle.

The high pressure exit gases pass through a final cooler 80 to substantially reduce the gas temperature before entry into the storage receiver 78. Unless the storage receiver is cooled for storage of a cryogenic liquid, the high pressure gas is stored at ambient temperatures. The gas storage receiver 78 has a supply line 82 with a bleed line 84 that leads to an expander generator 86. The generator allows the high pressure gas to expand with recovery of some energy in the form of electrical current. The expansion of the highly pressurized gas provides a cooling medium that can be advantageously utilized to substantially reduce the temperature of the gas charge being compressed by the compressor.

Expanded gas enters a port 85 leading to a large plenum 86 around the high pressure stage chamber 58 for metered entry through a passage 88 in the head 20 that is regulated by an electronically actuated poppet valve 90. The electronically actuated poppet valve 90 opens strategically during the charging phase of the compression cycle 58 to allow a quantity of cooled and partially expanded gases to enter the high pressure stage chamber 58 through the volumetric chamber 66. The charge of cryogenic cooled gas mixes with the compressed gas charge entering through the small passage 72 and through the ports 64. The mixed gases rapidly reach an equilibrium temperature and pressure as the compression stroke of the small diameter segment of the piston commences compression. Compression continues until the stepped piston reaches the top of the chamber 58 as shown in FIG. 1.

The poppet valve 90 is spring biased by a compression spring 94 to closure and is pressure actuated by pressure entering a cylinder 96 as controlled by an electronically operated slide valve 98 shown schematically in FIGS. 1 and 2. Actuation of the electronic slide valve 98 is controlled by an electronic control module 100 that includes a temperature sensor 102 and a timing sensor 104. The timing sensor 104 detects the rotational cycle of the crankshaft of the compressor unit 10 and provides a timing signal for the control module to control the opening and closing of the poppet valve 90. The temperature sensor 102 monitors the temperature of the compressed exit gases from the compressor unit 10 and connects to a thermostatic control 104 that generates a control signal that is transmitted to the electronic control module 100 to regulate the duration that the poppet valve 90 is opened during each cycle of operation of the compressor unit 10. If desired, the electronic control module 100 can utilize an additional temperature sensor 105 that is located in the expanded gas plenum 86 in order to factor in the temperature of the expanded gas in the plenum. Adjustments to the timing and duration of the valve operation can be made according to the temperature of the partially expanded gas in the plenum 86 as well as the temperature of the discharged gas.

Figure 3:
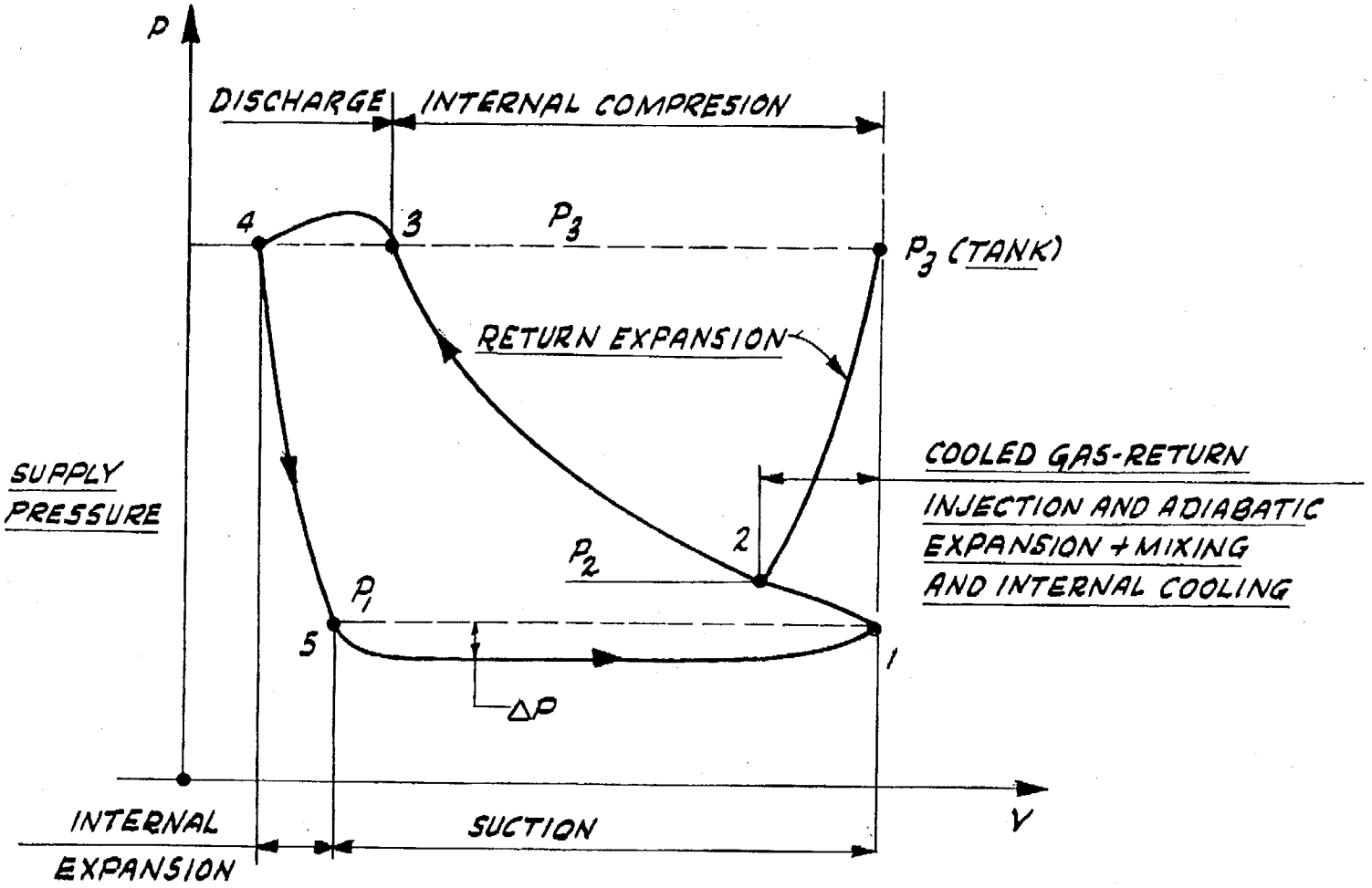
FIG. 3 is a schematic view of a pressure-volume diagram for the operating cycle of the compressor unit of FIG. 1.

Referring now to FIG. 3, a pressure-volume diagram depicts the mixed cycle for the high pressure, second stage compression. It is to be understood that this stage can be the sole stage in a compressor unit, particularly where the supply pressure is from a precompressed source, such as a gas maintained at 100 psi, or the large diameter chamber 70 is used for gas expansion. During the suction stage of the small diameter segment 36 of the stepped piston 32, a charge of gas enters the top intake 60 and then the bottom intake 54 for charging the chamber 58. This is represented by point 5 to point 1 in the PV diagram. As the compression stroke commences, the expander valve 90 is opened allowing high pressure expansion gas from the expander 86 to enter through the top of the volumetric chamber 66 cooling the strategic parts as it enters the compression chamber 58 and reaches an equilibrium pressure at point 2 on the PV diagram. At this point, the compression stroke has already closed the ports 64 such that the cooling gas is retained in the compression chamber 58 and volumetric chamber 66. The compression stroke continues until point 3 is reached on the PV diagram which equals the pressure of the storage tank. At this point, the flap valve 74 that has been biassed to closure by the pressure in the storage receiver opens and allows gas to pass to the receiver during the elevated pressure segment between point 3 and point 4 on the PV diagram. When the discharge ceases and the flap valve closes, the compression stroke is completed and internal expansion occurs between point 4 and point 5 on the PV diagram as the trapped gas in the volumetric chamber 66 expands into the compression chamber 58 and before the flap valve 68 of the top intake opens and supplies an additional charge during the next suction phase between point 5 and point 1.

In order to appreciate the substantial cooling effect of the expanded gases from the high pressure storage receiver 78 that is maintained at adiabatic temperature, the following analysis is provided using a reference pressure ratio of 40 to 1 in this stage.

$$T_{2REC} = T_3 \frac{1}{\left(\frac{P_3}{P_2}\right)^{\frac{k-1}{k}}} \cong T_1 \frac{1}{\left(\frac{P_3}{P_{2REC}}\right)^{\frac{k-1}{k}}}$$

The temperature and the pressure by compressing the sucked gas will be considering a separate process.

$$T_2 = T_1 \left(\frac{P_2}{P_1}\right)^{\frac{k-1}{k}}$$

By mixing the expanded—cooled—recirculated gas, with the compressed new charge will have, the participation (mass) of the:

$M_2$=New charge mass $M_2$(rec)=Recirculated mass

The mass ratio will be $\mu = M_2/M_{2rec}$ Using Dalton law for mixing the temperature of the mixed gas will be:

$$T_{02} = \frac{M_{2REC} \times T_{2REC} + M_2 T_2}{M_{2REC} + M_2} = \frac{T_{2REC} + \mu\, T_2}{1 + \mu}$$

Point 3 compressing the mixture at the final phase of compression, the final temperature $$T_F = T_3 - T_{02} \left(\frac{P_3}{P_2}\right)^{\frac{k-1}{k}} = \frac{T_{2REC} + \mu\, T_2}{1 + \mu} \left(\frac{P_3}{P_2}\right)^{\frac{k-1}{k}}$$

and because

-continued $$\frac{P_3}{P_2} \times \frac{P_2}{P_1} = \frac{P_3}{P_1} = \pi = \rightarrow \text{Total Pressure Ratio}$$

and considering $$\frac{P_2}{P_1} = \delta, \text{ will result}$$

$$\frac{P_3}{P_2} \times \delta = \pi \text{ AND } \frac{P_3}{P_2} = \frac{\pi}{\delta}$$

From all these equation will result the value of the final temperature $$T_F = \left[ \frac{T_1}{\left(\frac{P_2}{P_1}\right)^{\frac{k-1}{k}}} + \mu T_1 \left(\frac{P_2}{P_1}\right)^{\frac{k-1}{k}} \right] \times \frac{1}{1+\mu} \left(\frac{P_3}{P_2}\right)^{\frac{k-1}{k}} = T_3$$

$$T_F = \left[ \frac{1}{(\pi/\delta)^{\frac{k-1}{k}}} + \mu (\delta)^{\frac{k-1}{k}} \right] + \frac{T_1}{1+\mu} \left(\frac{\pi}{\delta}\right)^{\frac{k-1}{k}} = \frac{T_1}{1+\mu} \left(1 + \mu \pi^{\frac{k-1}{k}}\right)$$

For example having $\pi = 40 = P_3/P_2$ $\mu = M_2/M_{2rec} = 1$; $T_F = 587°$ K.$= 314°$ C.

For M rec=0.5M $\mu = M_2/0.5M_2 = 2$; $T_{F2} = 682°$ K.$= 409°$ C.

For M rec=0.25M $\mu = M_2/0.25M_2 = 4$; $T_{F2} = 758°$ K.$= 485°$ C.

For M rec=0.1M $\mu = M_2/0.1M_4 = 10$: $T_{F2} = 820°$ K.$= 547°$ C.

The real value of the $\mu = M_2/M_{2rec}$ is the factor which is determining the final temperature TF, to not over-boat the compressor.

A temperature sensor (T) controlling the discharge gas temperature before the final cooler is commanding a thermostatic device (TS), which is controlling the electromagnetic valve—for return—and recirculation of the—cooled—gas expanded in the compressor.

For conventional compression without any recirculation—cooling the final temperature.

$$T_F = T_3 = T_1(\pi)^{\frac{k-1}{k}} = 300° \times 40^{0.29} = 300 \times 2.91 = 874° \text{ K.} = 601° \text{ C.}$$

For the case 1 with $\mu = 1$

The final temperature $T_F = 314°$ C. is definitely half from the case of conventional.

Figure 4:
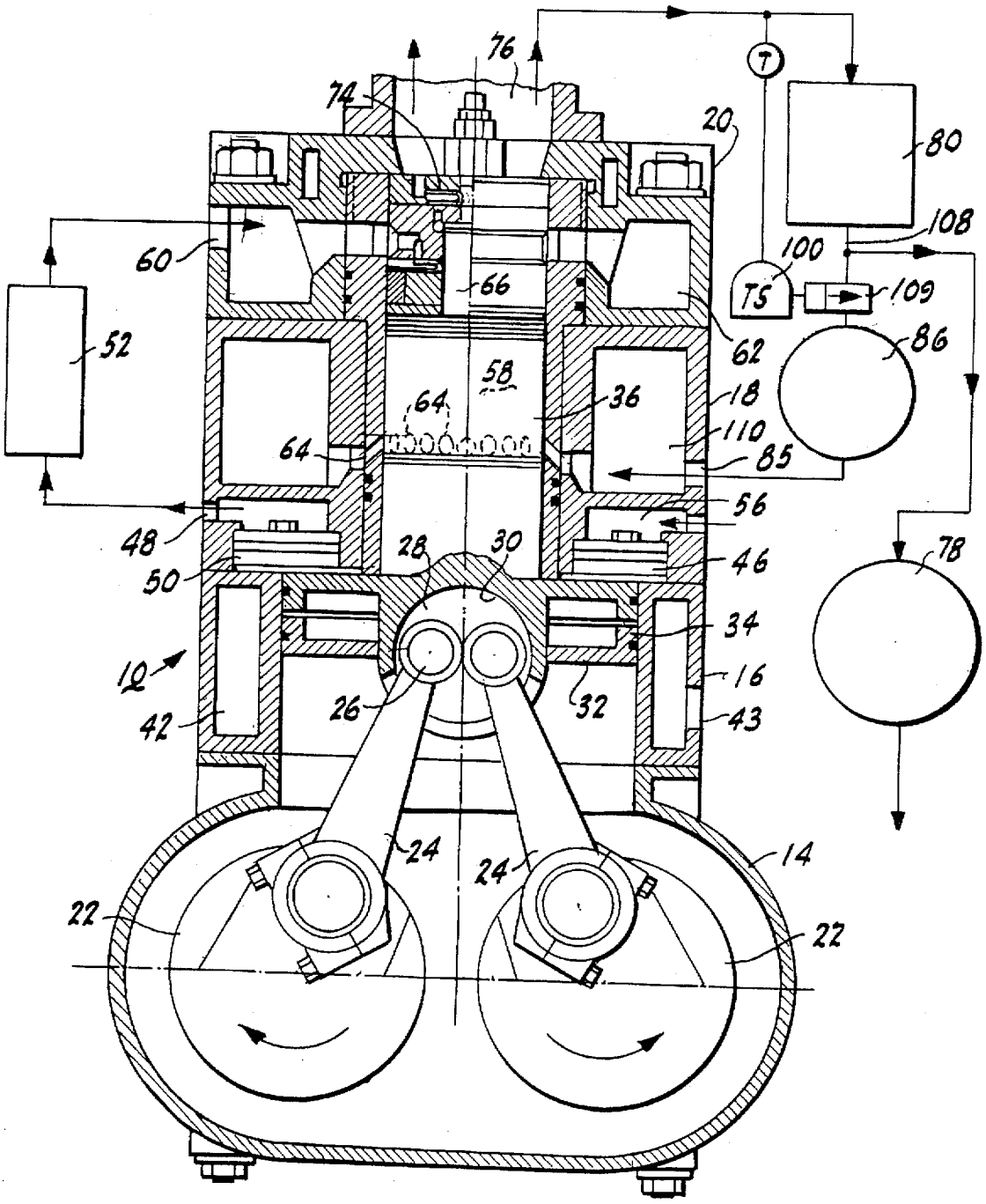
FIG. 4 is a cross-sectional, elevational view of a first alternate embodiment of the compressor unit.

Referring now to FIG. 4, an alternate embodiment of the compressor unit is shown. The basic components and the operation of the stage one compression are essentially identical to that described with reference to FIGS. 1 and 2. In the embodiment of FIG. 4, the charge of compressed gas from the stage one compression by the large diameter segment 34 of the stepped piston 32 enters the high pressure compression chamber 58 at the top via the intake passage 60 which enters the chamber 58 through the flap valve 74 and volumetric chamber 66. The expansion gas in the line 108 that communicates with the high pressure adiabatic gas in the storage receiver 78 is released through an electronically controlled valve 109 to the expander-generator 86 and enters an enlarged plenum 110 around the high-pressure-stage compression chamber 58. The expanded and cooled gas enters the bottom of the chamber 58 through ports 64 that are exposed when the small diameter segment 36 of the stepped piston 32 is retracted.

As in the embodiment of FIG. 1, the mixed and cooled trapped gas in the compression chamber 58 and volumetric chamber 66 is compressed during the compression stroke until the pressure exceeds the back pressure from the storage receiver 78. Then, the flap valve 74 allows passage of the highly compressed gas through the exit passage 76 to the final cooler 80 associated with the storage receiver. The minor variation in the schematic arrangement of the auxiliary components shown in FIG. 4 provides for location of the final cooler 80, expander 86 and electronic control 100 to be situated proximate the compressor unit 10 with a distant location of the storage receiver 78.

Figure 5:
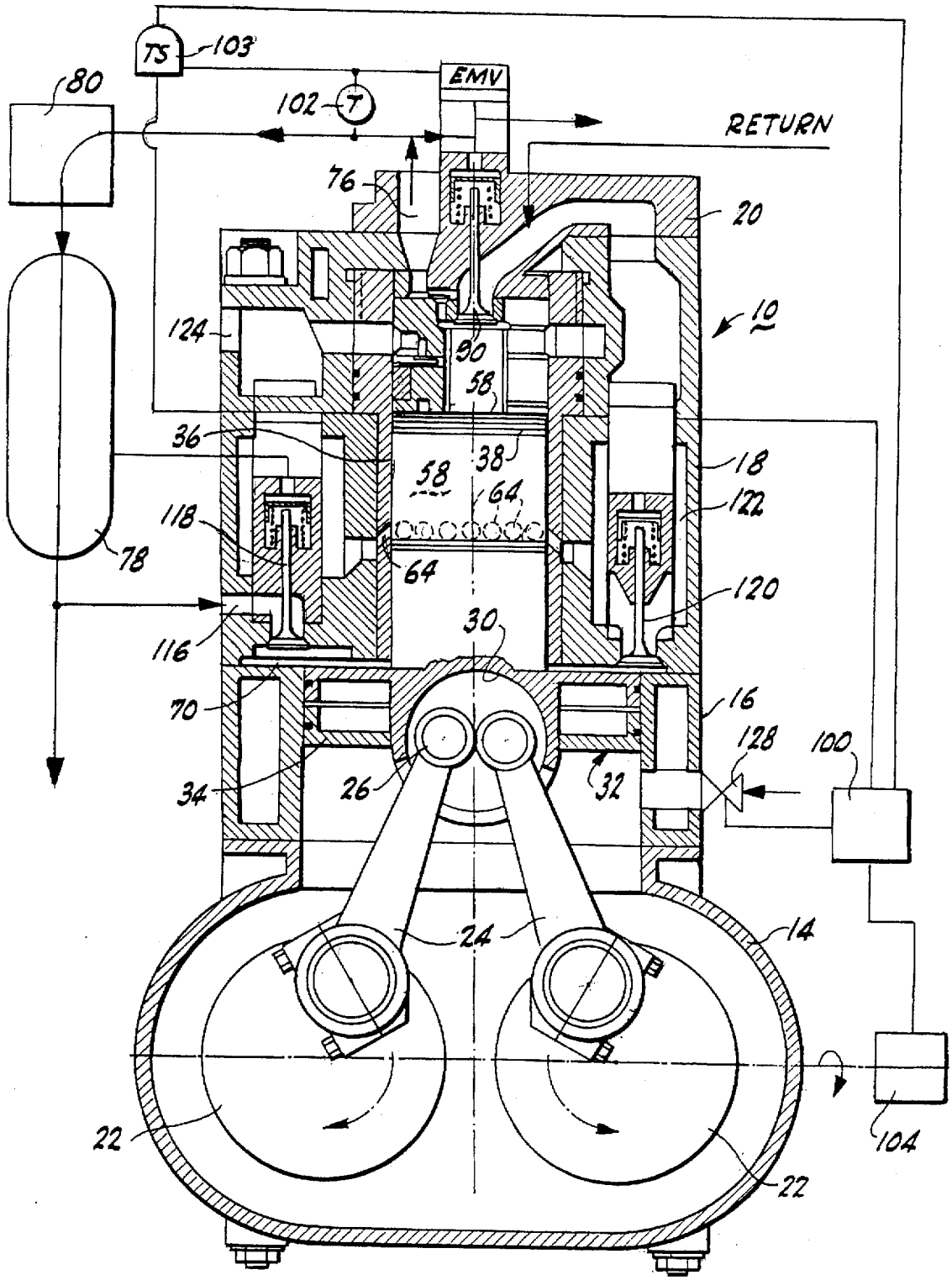
FIG. 5 is a cross-sectional, elevational view of a second alternate embodiment of the compressor unit.

Referring now to FIG. 5, a further embodiment of the compressor unit 10 is disclosed. In this embodiment, a metered supply of high pressure gas at ambient temperature is delivered through an intake port 116 under controlled regulation of an electronically controlled poppet valve 118 for entry into the low pressure chamber 70, which here functions as an expansion chamber for the high pressure gas. Work is recovered by the large diameter segment 34 of the stepped piston 32 as the gases expand and cool. During the compression stroke, the large diameter segment 34 of the stepped piston 32 displaces the gases in the low pressure chamber 70 and upon actuation of a second electronically operated poppet valve 120 passes the gases to a plenum 122 controlled release into the high compression chamber 58 at the optimum time in the operating cycle. This occurs during the period when the small diameter segment 36 of the piston 32 is retracted and initiating its compression stroke.

Prior to this phase in the operating cycle, a charge of gas to be compressed has entered through the intake port 124 during the suction stroke of the small diameter segment of the stepped piston. Again, a temperature sensor 102 senses the temperature of the discharge compressed gas and is coordinated with a timing signal from a timing sensor 104. An electronic control module 100 analyses the sensor signals and generates an actuation signal for timed opening and closure of the poppet valve 90.

In the event that the operating conditions are such that the efficiency is being undermine by the low pressure chamber 70 going into vacuum during the suction stroke of the large diameter segment of the stepped piston 32, then a supplemental charge of supply gas enters through an optional one-way valve. This feature also operates when the supply gas is delivered to the compressor unit under low or moderate pressure from a supply source, such as a pipeline. This feature prevents overcooling or efficiency loss in the system where the large diameter segment of the piston functions as the expander.

Figure 6:
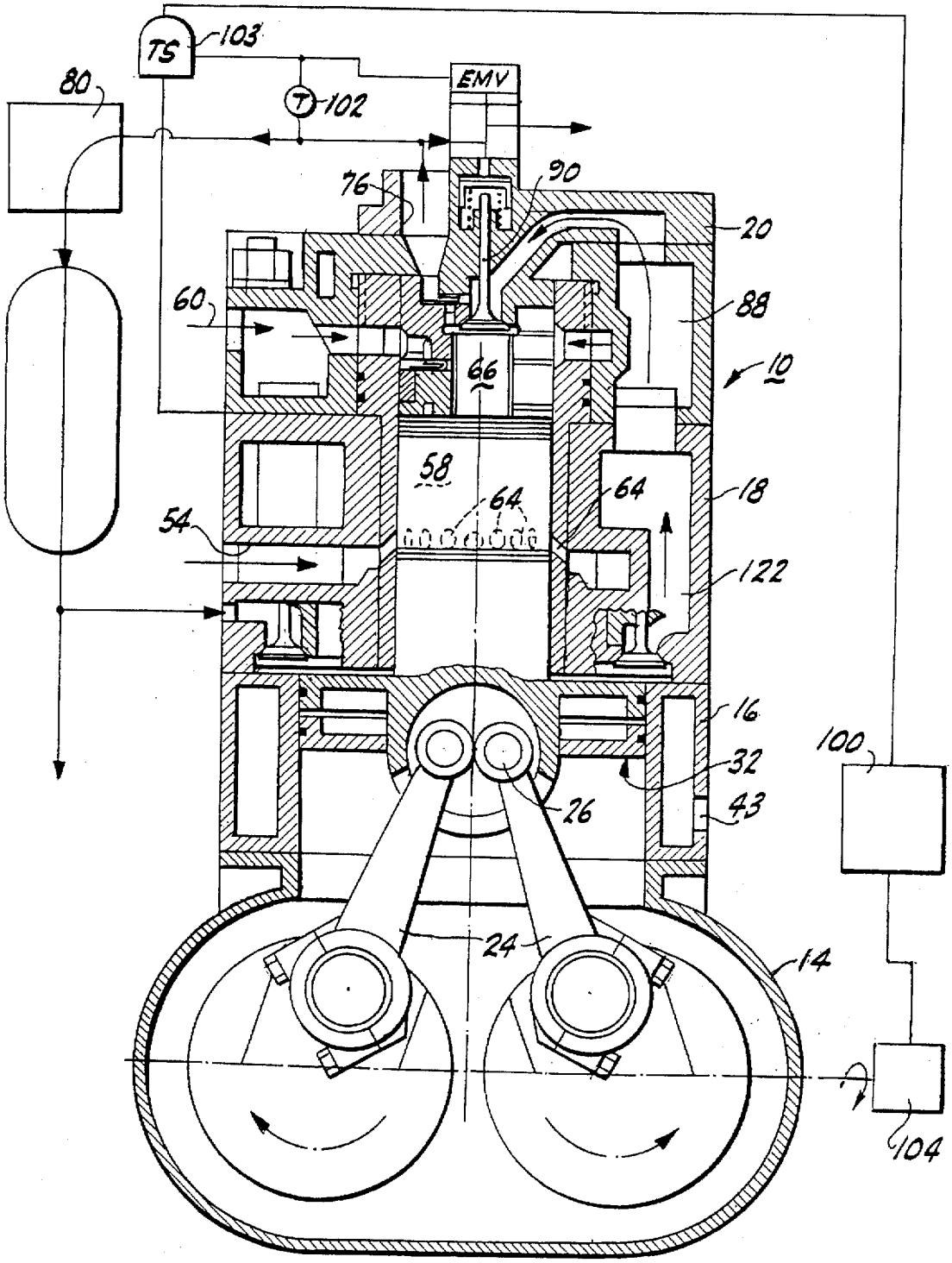
FIG. 6 is a cross-sectional, elevational view of a third alternate embodiment of this compressor unit.

Referring now to FIG. 6, the further embodiment of the compressor unit 10 shown includes most of the features of the embodiment described with reference to FIG. 5. In the embodiment of FIG. 6, the charge of cooling gas displaced by the large diameter segment of the stepped piston 32 is not admitted through the port 64 in the high pressure chamber 58, but solely through the passage 88 communicating with the volumetric chamber 66 under controlled release by the electronically operated poppet valve 90. Release of the expanded cooling charge is controlled by the electronic control module 100. A thermal sensor 102 monitoring the discharged temperature and a timing sensor 104 monitoring the phase of the cycle, allows computation of the optable timing and duration of the release of the cooling gas by the electronic driver 103.

The supply charge of gas to be pressurized enters through the top intake 60 and the bottom intake 54. Because the charging of the supply gas is improved in efficiency over the system described with reference to FIG. 5, the optional supply through the one-way valve 128 of FIG. 5 is not required. Furthermore, because cooling gas is not supplied through the side ports 64, a charge of coolant can be delayed in the cycle of compression for optimized release into the high pressure chamber 58.

Figure 7:
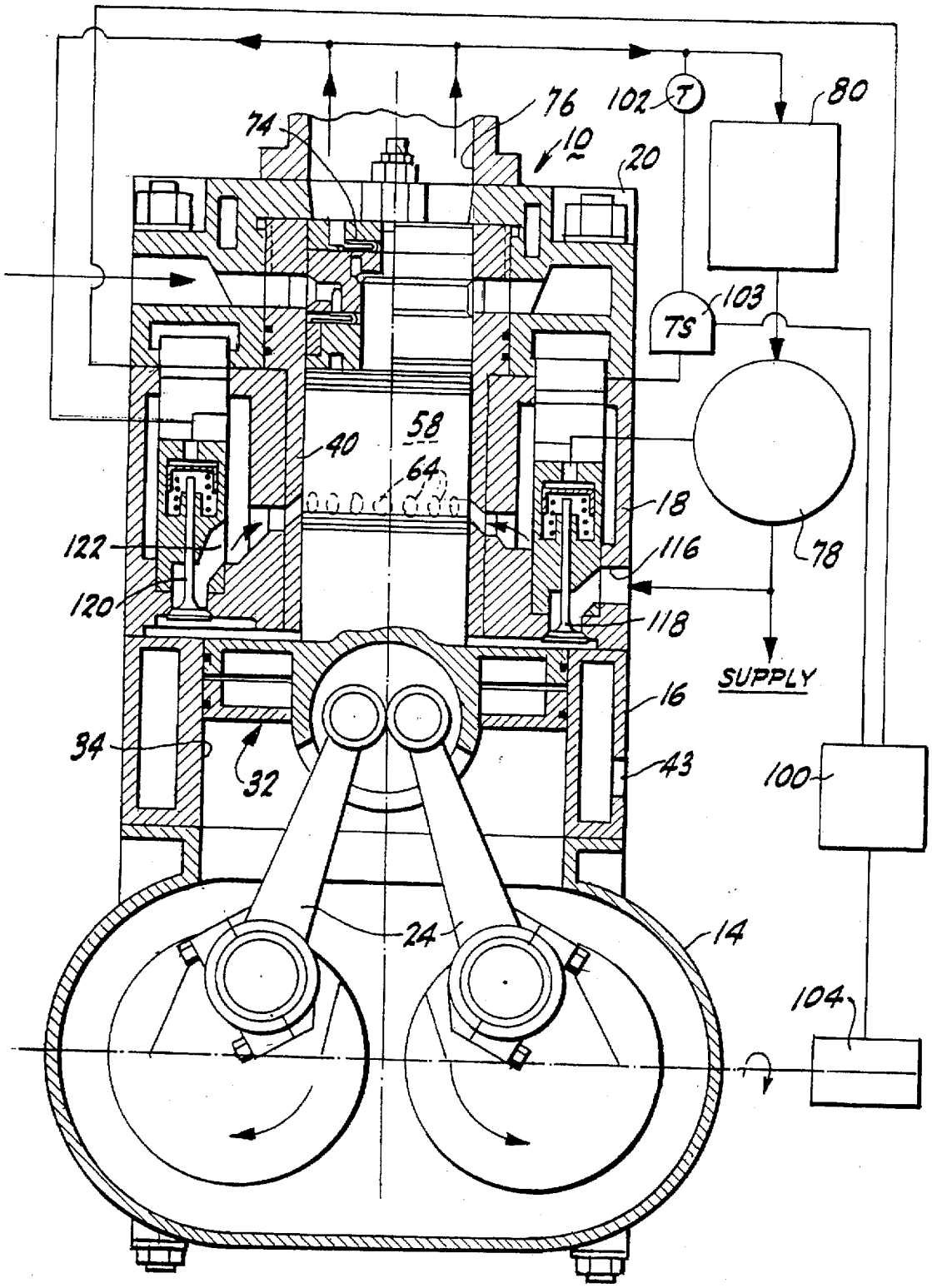
FIG. 7 is a cross-sectional, elevational view of a fourth alternate embodiment of the compressor unit.

Referring now to FIG. 7, a further embodiment of the compressor unit 10 is shown. The compressor unit 10 is similar to the unit of FIG. 5 with the top electronic metering valve 90 of FIG. 5 is omitted. In this embodiment, the large diameter segment 34 of the piston 32 again functions as an expander under control of an admission valve 118 for metering the supply of high pressure gas from the storage vessel 78. A similar electronically controlled poppet valve 120 provides for timed release of the expanded and displaced gas into the plenum 122. The plenum communicates with the ports 64 along the wall of the liner 40 in the high pressure chamber 58. Pressurized gas is discharged through an exit passage 76 through a one-way valve 74 at the end of the volumetric chamber 66.

Figure 9:
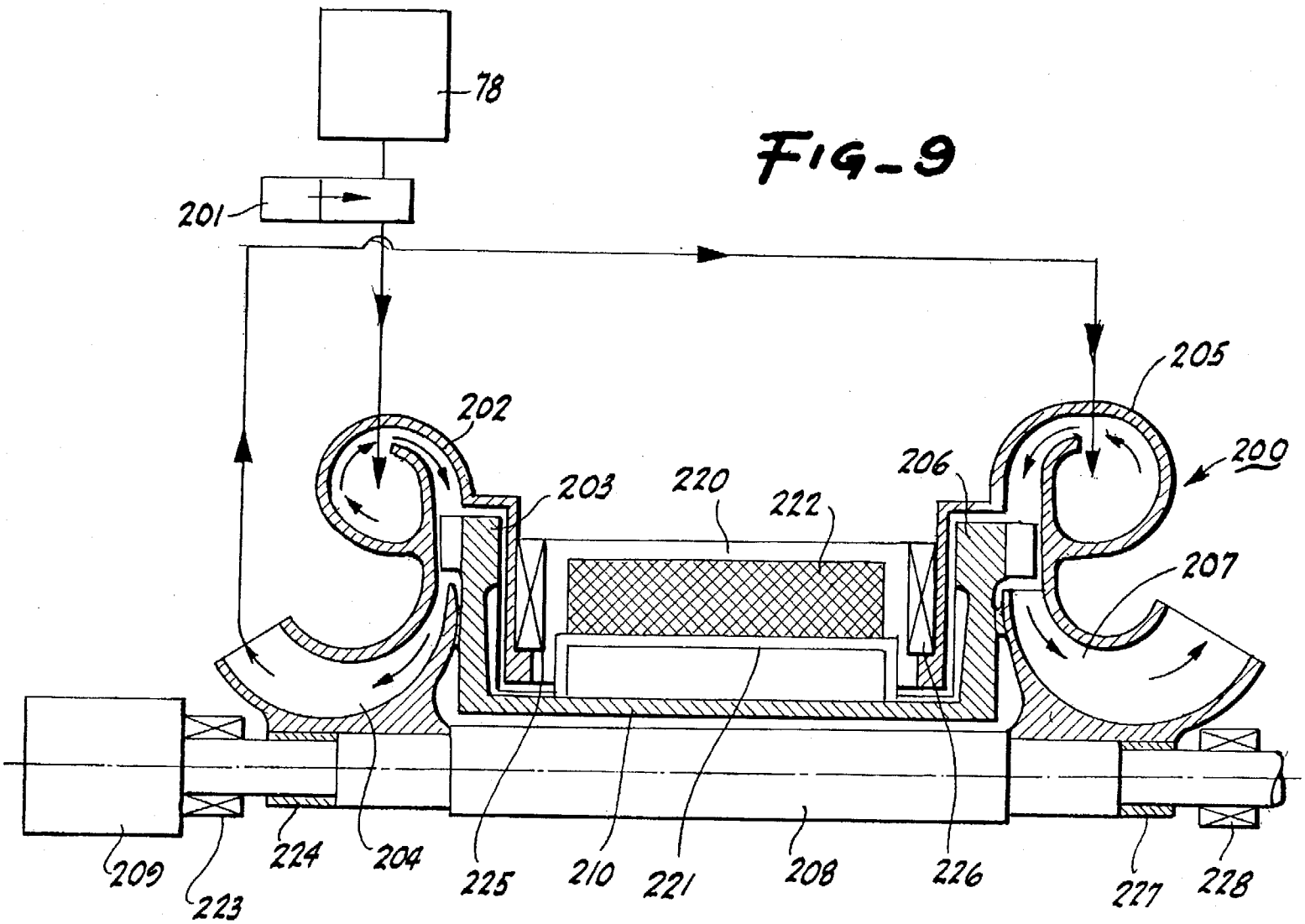
FIG. 9 is a cross-sectional, elevational view of a dual, counter-rotating expander unit used in conjunction with certain embodiments of the compressor units.

In each of the embodiments where it is preferred to use an external expander in order to take advantage of the two-staged compression, the preferred expander is of a type shown in FIG. 9. as described hereafter.

Figure 8:
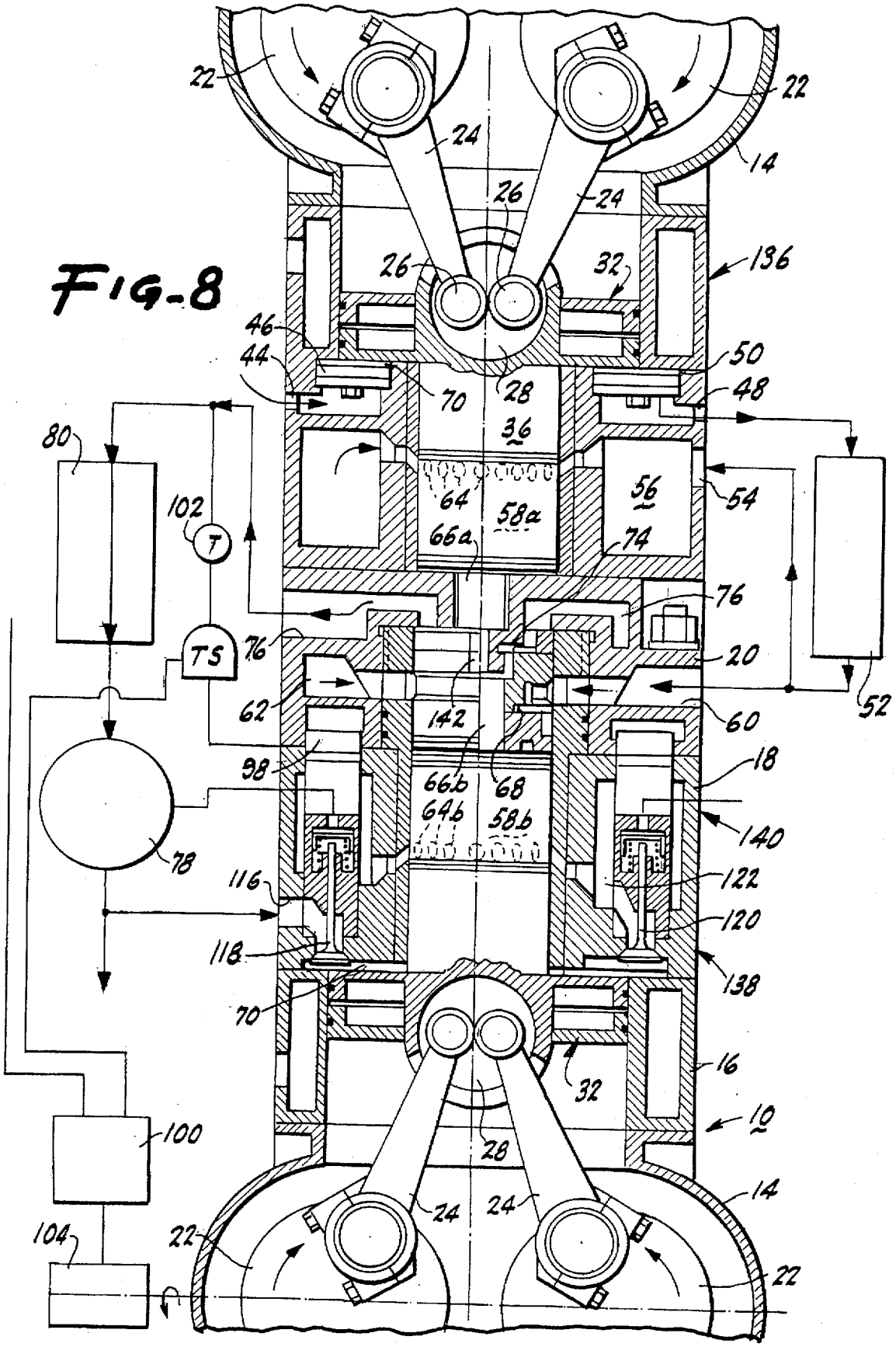
FIG. 8 is a cross-sectional, elevational view of a fifth alternate embodiment of the compressor unit.

Referring now to FIG. 8, a compressor unit 10 has a combined two-stage compressor section 136 coupled to an expander-compressor section 138 forming an opposed piston unit 140. The opposed piston unit 140 essentially combines the integrated expander and compressor unit of FIG. 7 and the two stage compressor unit of FIG. 4. In the opposed piston unit 140, the volumetric chamber **66*b* of the expander-compressor section 138 communicates via a open passage 142 with the volumetric chamber 66*a* of the two-stage compressor section 136. Each of the two sections, 136 and 138 share a common exit passage 76 protected by a one-way flap valve 74 for discharge of high pressure gases to a final intercooler 80 before the highly compressed gas is transferred to a storage receiver 78. The opposed piston configuration of the combination unit 140** utilizes the same dual crank and piston rod assembly to withstand the extreme forces required to generate the resultant high pressure of the delivered compressed gas.

At each end of the combined unit 140 is a crankcase 14 with counter-rotating crankshafts 22, dual connecting rods 24 and wrist pins 26 in mutual rolling contact to eliminate side thrust and side force friction. The rolling wrist pins provide a large projected surface area for absorbing the piston forces transferred to the hemispherical bearing 28 housed in the stepped piston 32. These features are designed to absorb huge pressures in the compression chambers and are described in greater detail in the patents that are referenced. The operation of the compression system is similar to that previously described and has a combined compression cycle with a concurrent expansion phase to substantially reduce the temperature of gases compressed to allow a high pressure to be achieved without thermal detriment to the components of the compressor unit 140.

In operation, gas at ambient or precompression pressures is admitted through intake port 44 through one-way valve 46 and into a low pressure chamber 70 during the suction stroke of the stepped piston 32 in the two stage compression section 136 of the combined unit 140. During the compression stroke, the automatic one-way valve 46 closes and a similar valve 50 opens to discharge first-stage compressed gas through an exit port 48 to an intercooler 52. The intercooler 52 discharges to two intake ports 54 and 60. The gas intake port 54 leads to a plenum 56 that supplies a charge of compressed gas to the high pressure, compression chamber 58a through the cylinder ports 64 when the small diameter segment 36 of the stepped piston 32 is retracted. Simultaneously, a charge of compressed gas is delivered through intake port 60 to a plenum 62 and through flap valve 68 for supplying the high-pressure compression chamber **58*b* of the expander-compressor section 138 of the combined unit 140**.

Concurrently with the supply of the charge of gas to be compressed, a charge of high pressure gas at ambient temperature is delivered from the storage receiver 78 to intake port 116 for expansion in the compression chamber 70 that functions in part as an expansion chamber. As noted, work may be recovered by the piston assembly by the adiabatic expansion of the high pressure gas. The quantity of gas delivered is metered by a protective poppet valve 118 that is electronically actuated by an electronic slide valve actuator 98 that utilizes the high gas pressure from the storage vessel to operate the poppet valve 118 in a manner previously described.

During expansion, the metered charge from the storage vessel 78 is chilled by action of the expansion. During the compression stroke of the stepped piston 32, the large diameter segment 34 displaces the chilled gas into a plenum 122 upon timed retraction of the electronically actuated poppet valve 120. The displaced gas enters the high pressure compression chamber **58*b* through the port 64*b* and mixes with the charge of compressed gas entering the high pressure, compression chambers 58*a* and 58*b* from the two stage compression section 136 of the combined unit. The mixture quickly reaches equilibrium and reduces the temperature of the supply charge at the commencement of the compression stroke of the two opposed pistons. Once the pressure in the volumetric chambers 66*a* and 66*b* exceeds the pressure in the storage vessel 78, the charge of highly compressed gases passes through the one-way valve 74 to the final cooler 80 and then to the storage receiver 78**.

As in the previously described embodiments, the timing and duration of the electronically operated valves 118 and 120 are controlled by an electronic control module 100 using a timing cycle sensed by a timing sensor 104 and a duration resulting from analysis of a signal from the thermal sensor 102. In this manner, the quantity of the cooling gas admitted and the timing of the admission can be optimally controlled by the processor 100.

It is to be understood that variations in a combination unit can be effected by different components and different routing of the gas streams. In the drawings of the embodiments shown, the pistons are at their top dead center, and provide a virtually complete displacement of the compression chambers. The compression ratio is thereby determined primarily by the size of the volumetric chambers in relationship to the sizing stepped piston. It is understood that depending the medium to be compressed and the desired compression ratios sought, component sizes can be adjusted accordingly. The unit is designed to operate at relatively high speeds for a compressor and an overall volumetric efficiency that compensates for the partial losses in compressed gas by use of this unique cooling system. The compressor units can be driven by electric motors or other drive means such as a natural gas powered engine. It is to be noted that the compressor units of this invention can be utilized with other types of expander units allowing the opposed piston unit to operate with both sections as compressor sections and can be utilized as the final stages in multi-stage compressor systems or systems where the compression medium has been pre-compressed as in pressurized supply lines. The compressor units disclosed have particular application for natural gas, and can be utilized to generate the pressures necessary for liquidation of the pressurized gases on final cooling. Additionally, the compressor units can be utilized wherever high volume compression is desired, for example, for air, carbon dioxide and other gases where pressurized gas or liquified gas is desired.

Where external expansion is preferred, a high volume, dual gas expander as shown in FIG. 9, is preferred. The dual stage expander, designated generally by the reference numeral 200, operates from a supply of high pressure gas from the storage vessel 78 as released by an electronically controlled control valve 201 to a first stage of a counter-rotating turbo-expander 202. The expanding gas drives a first rotor 203 in a first direction and a second rotor 204 in an opposite direction. The rotors 203 and 204 are connected by a conduit to the third and fourth stage expander rotors 206 and 207. The output of rotor 204 is delivered to the stationary intake 205. In this manner, central rotors 203 and 206 are connected by common shaft 210, which is concentric to inner shaft 208 for driving the generator 209. The concentric shaft 210 drives the rotor 221 within the stator 222 of the second generator 220.

The connected shafts of the turbo-expander and generator unit 200 are suspended on combined bearings 223, 224, 225, 226, 227 and 228 that are electro magnetic air bearings. In this manner, the bearings can be supported for high speed operation without lubrication and friction. Energy can be extracted from the expanding gases in the form of an electrical output. It is expected that the compressor units of this invention may be utilized in remote areas without electrical power for operation of the electronic metering system. The recovery of energy in the form of electricity can be helpful for generating the necessary power for the electronic control systems of the compressor units.

Figure 10:
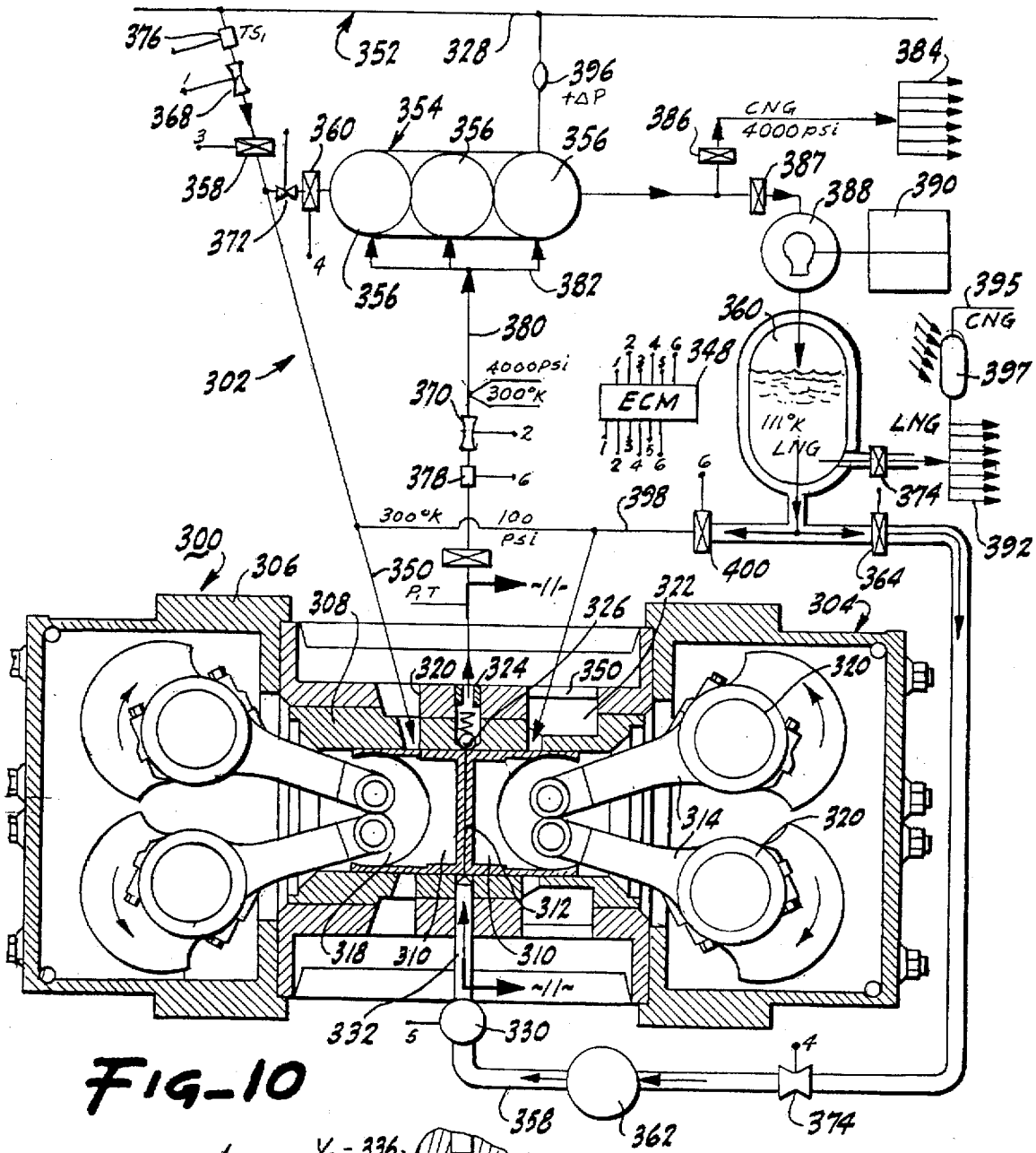
FIG. 10 is a cross-sectional, elevational view of a further embodiment of a compressor unit with auxiliary components shown schematically.

Referring now to the single-stage compressor unit 300 shown in FIG. 10, a gas system is shown utilizing natural gas which is the primary gas for which this system is designed. Variations in temperatures, pressures and other parameters of the system may be required for use of other gases that are liquefiable and adaptable to the type of system shown in FIG. 10. The system shown in FIG. 10, is designed as a filling station 302 for boosting the supply pressure of gas from a typical supply line pressure of 100–150 psi to 4000 psi. Additionally, the filling station transforms high pressure gas to liquified gas for storage and delivery to auxiliary systems as well as for use in the single stage compressor unit 300 to maintain substantially isothermic compression. Key to the overall economy of the filling station 302 is the incorporation of recovery systems, for example, power recovery through adiabatic expansion of compressed gas to boost the overall efficiency of the system. The product of the filling station 302 is natural gas at ambient temperature and a delivery pressure of 4000 psi, and in addition, liquified natural gas contained at the refrigerated temperature of 111° K.

As shown in FIG. 10, the preferred construction of the compressor mechanism 304 that forms the primary component of the compressor unit 300 is an opposed-piston, positive displacement system, having a design substantially the same as the high pressure reciprocator components described in U.S. Pat. No. 4,809,646, referenced hereinbefore. The compressor mechanism 304 includes an external housing or block 306 with a central cylinder liner 308 that together with a pair of opposed pistons 310 defines a cylindrical compression chamber 312. The compression chamber 312 is shown minimized with the opposed pistons 310 positioned at top dead center in FIG. 10. The cycle of operation, is described subsequently with reference to FIGS. 13.1–13.5.

The high compression ratio of 40:1 is obtained by the unique structural components that form the compressor mechanism 304. Each piston 310 is connected to dual connecting rods 314 that at one end have fixed wrist pins 316 in mutual rolling contact. The wrist pins 316 are seated in a spherically articulated bearing assembly 318 for maximizing pressure distribution to bearing surfaces and minimizing friction and distortions resulting from thermal stresses in the pistons 310 and the liner 308. At the other end of the connecting rods 314 are dual crank assemblies 320 that are connected to a drive mechanism, (not shown) which may be a natural gas fired, opposed piston engine similar in construction to the compressor mechanism 304 of FIG. 10.

The compression chamber 312 has intake ports 320 and 322 which are exposed when the pistons 310 are retracted for acceptance of a new charge of gas to be compressed. Compressed gas is discharged through a discharge passage 324 protected by a spring-loaded check valve 326.

To enable the supply gas delivered through gas supply line 328 to be compressed within a temperature range that is compatible with the thermal limits of the structural components of the compressor mechanism 304, a novel cooling process has been devised. To achieve substantially isothermic compression, in addition to the initial expansion of residual compressed gas in the compression chamber 312 during the expansion stroke before the initial stage of intake, a pulse of liquid natural gas is injected during compression. Since the liquid natural gas is in the liquid form during injection, the timing and duration of the injection pulse can be strategically controlled for optimization of the compression cycle. To accomplish this injection process, a liquid coolant injector 330 is incorporated on the compressor mechanism 304 with an injector nozzle 332 centrally located in the compression chamber 312 such that the injection pulse can be effected at any time during the compression stroke.

Figure 11:
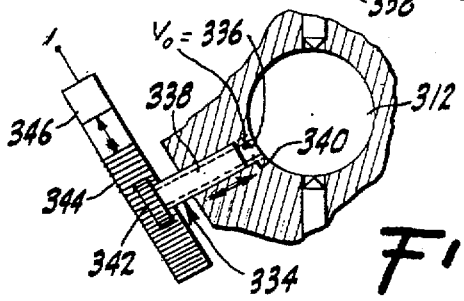
FIG. 11 is a partial cross-sectional view taken on the lines 11—11 in FIG. 10 showing a volume adjustment control.

The compressor mechanism 304 is also equipped with a volumetric control mechanism 334 shown in FIG. 11, comprising a small volumetric chamber 336 adjacent the central portion of the compression chamber 312. The volume, $V_o$ of the volumetric chamber 336 is determined by the position of a displaceable piston 338 that threadably engages a bore 340. The threaded piston 338 is connected to a pinion 342 on a displaceable rack 344 under control of a solenoid 346 electronically connected to an electronic control module 348. The electronic control module has output terminals 349 connected to various electronically controlled components of the type described herein for regulation of the operation of the compressor unit 300. It is to be understood that certain control valves that are part of the filling station, but not integral to operation of the compressor unit may be controlled manually or by a separate control module associated with the general operation of the filling station 30.

The compressor unit 300 includes a gas supply passage 350 that is connected to a high pressure supply source 352, which is in the form of a gas transmission line 328 that is maintained at approximately 100–150 psi. Also connected to the gas supply passage 350 is a high pressure gas source 354 in the form of three high pressure receiver tanks 356. The flow of gas delivered to the gas supply passage 350 from the two gas sources 352 and 354 may be regulated by electronic control valves 358 and 360 where adjustments to the pressure and temperature of the gas supplied to the compressor mechanism is desired to be regulated by a premixture process. Expanded gas from the high pressure receiver tanks 356 will cause a reduction in temperature to the supply gas that provides the initial charge for compression.

In the embodiment shown in FIG. 10, the supply gas is simultaneously delivered to each of the intake ports 320 and 322 to the compression chamber 312. In addition to the low pressure gas supply 352 from the gas supply line 328 and the high pressure gas supply 354 delivered to the receiver tanks 356, the compressor unit 300 includes a liquified gas supply line 358 connected to a liquified gas storage tank 360 for use as a coolant during compression. The liquified gas supply line 358 is a double walled conduit of the type generally used in supplying cryogenic liquids or transporting cryogenic liquids. A liquid pump 362 pressurizes the fluid for controlled injection by the coolant injector 330. The injector is preferably of the electronically controlled type under control of the electronic control module 348. Flow of the liquified gas, in this instance, liquified natural gas, is controlled by electronic control valve 364.

The electronic control module 348 includes input data from input terminals 366. The input terminals 366 connect to flow meters 368, 370, 372 and 374. In this manner, the flow of natural gas, in gaseous or liquid form, to the compressor mechanism 304 can be monitored by the electronic control module for adjusting the timing and duration of the operation of the electronically controlled valves 358, 360 and 364. Additionally, the flow meter 370 can monitor the quantity of gas discharged from the compressor mechanism and supplied to the receiver tanks. Furthermore, to optimize the system, temperature sensors 376 and 378 monitor the temperature of the supply of gas from the gas supply line 328 and temperature of gas in the high pressure gas discharge line 380. The temperature sensors can be combined with a pressure sensor as a confirmation check. The discharge line 380 interconnects the discharge passage 324 of the compressor unit 300 with the supply line 382 for feeding each of the three receiver tanks 356. It is to be understood that each tank 356 can be supplied independently of the other tanks such that pressure maintenance can be maximized.

In operation, the compressor unit 300 cooperates with the filling station system to supply high pressure compressed natural gas to a series of delivery lines 384 through mechanically or electronically operated valve 386. Additionally, the high pressure gas can be diverted through valve 387 and expanded in an expander 388, comprising a turbine that recovers energy of expansion in generator 390 for production of electrical power. The expansion through turbine 388 into the insulated storage tank 360 causes the partially expanded gas to liquify and accumulate in the liquified natural gas storage tank 360. From the storage tank 360, the liquified natural gas can be delivered to delivery lines 392 through valve 394.

Liquified natural gas can be transformed back into compressed natural gas in delivery line 395 by the application of thermal energy from a thermal source such as a solar collector or heat pump in expander 397.

During initial start-up of the filling station 302, natural gas is delivered to the receiver tanks 356 through check valve 396. Initially, an auxiliary supply of high pressure gas, and/or liquified natural gas is utilized to maintain the isothermic operating conditions of the compressor mechanism 304 during start-up compression. For example, liquified natural gas may be supplied through by-pass line 398 under the control of electronic control valve 400 and evaporated and expanded into the intake passage 350. It is to be noted that during the initial operation of the compressor mechanism 304 when the receiver tanks 356 are empty, the pressure and temperature of the discharge gas through the discharge passage 324 is only marginally greater than the temperature and pressure of the supply gas and the supply line. Gradually, as the receiver tanks 356 fill, the backpressure increases, and the requirement for the coolant supplement similarly increases. In order to maintain a substantially isothermic compression, the quantity, the timing and the duration of the supply liquified gas requires continuing adjustment under control of the electronic control module 348. Typically, the electronic control module includes a system map for comparing operating conditions for automatic adjustment as the process proceeds from low pressure, high volume transfer to the receiving tanks to low volume high pressure transfer.

Figure 12:
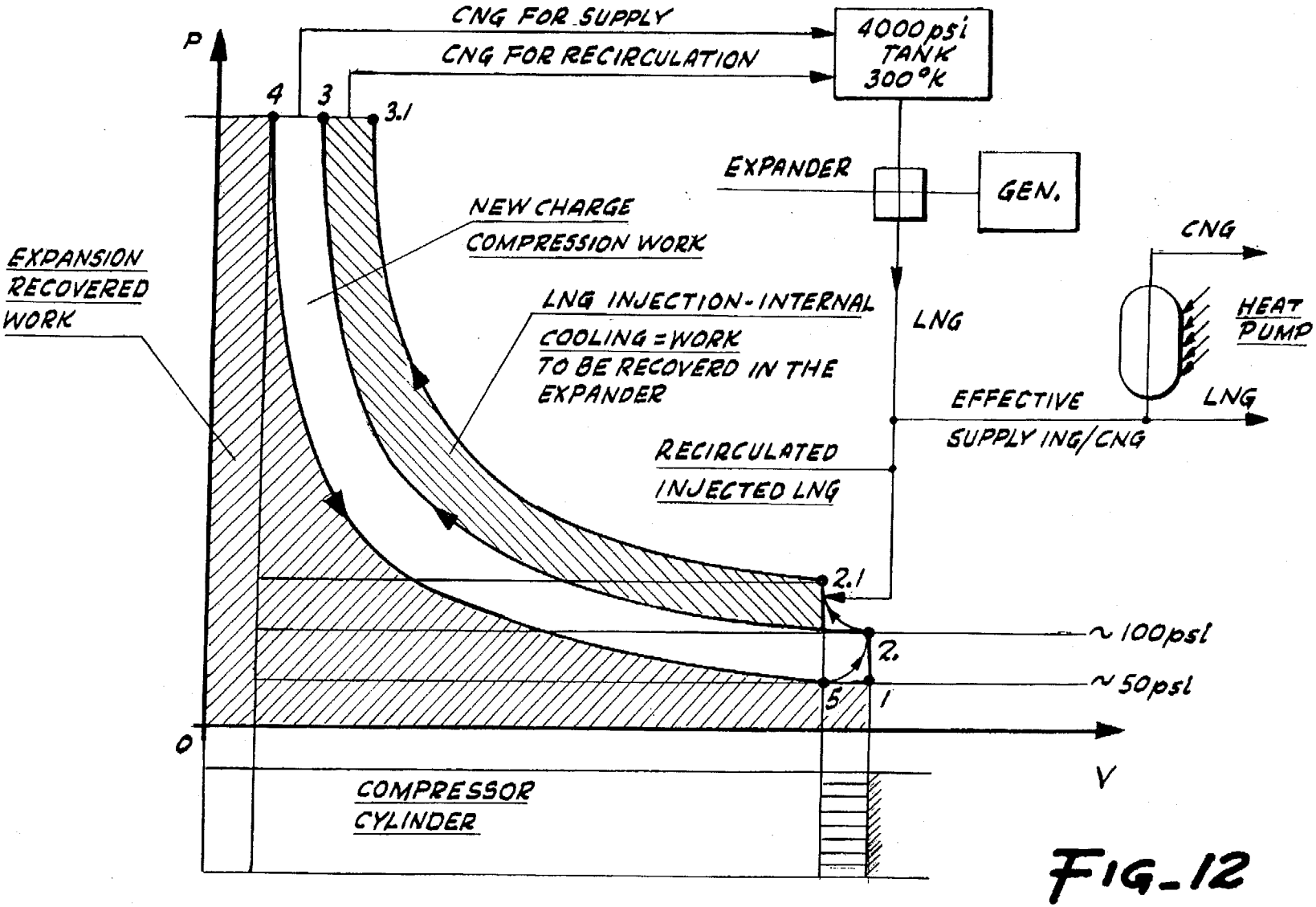
FIG. 12 is a schematic view of a pressure-volume diagram for the operating cycle of the compressor unit of FIG. 10.
Figure 13A:
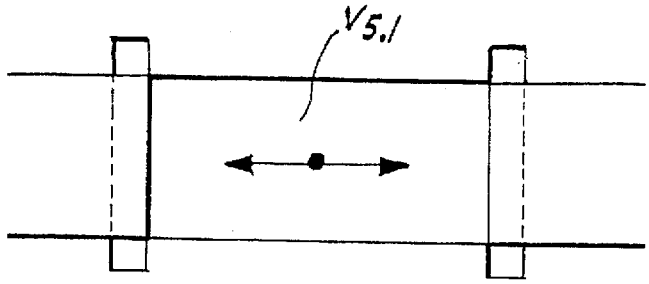
FIGS. 13A–13E are schematic illustrations of cycle phases of compression for the compressor unit of FIG. 10.

Referring to the pressure-volume diagram of FIG. 12, and to the schematic phase diagrams of FIGS. 13A–13E, the cycle of operation is apparent. As shown in FIG. 13A, the small portion of highly compressed gas remaining in the compression chamber after compression is expanded to the point that the pistons begin to expose the intake ports of the cylinder lining. At this point, natural gas that is isotermically compressed to 4000 psi at 300° K. has a pressure of 50 psi and a temperature of 80° K. which is under the boiling temperature of methane (111° K.) and under the freezing temperature 88° K.

Figure 13B:
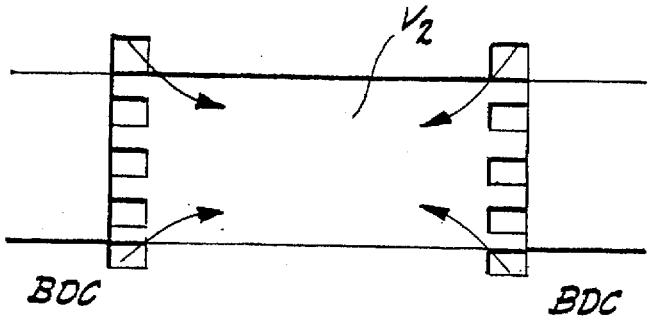
Figure 13C:
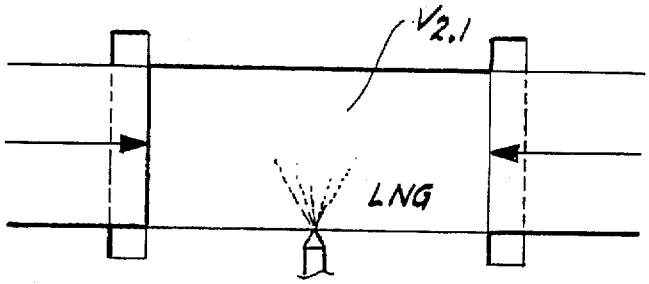
Figure 13D:
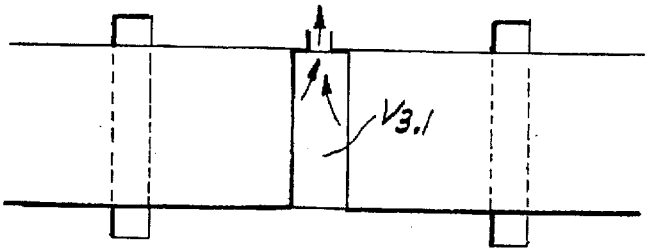
Figure 13E:
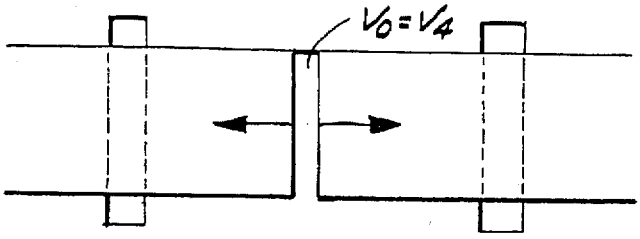

This temperature and pressure of the snow-like mist produced inside the cylinder is intermixed with the new charge of gas supplied during the end stroke of the pistons as shown in FIG. 13B. The mixture of gas in the cylinder or compression chamber is reduced in temperature to approximately 200° K. with a pressure equivalent to the line pressure of 100–150 psi. Once the intake ports are sealed by the compression stroke as shown in FIG. 13C, liquid natural gas is injected into the diminishing volume 2.1 during the compression stroke of the pistons. As noted, the volume and timing of the initiation and duration of the injected pulse of liquified natural gas is determined by the operating conditions of the filling station. For example, the profile of the injection pulse differs substantially when the receiving tanks are at low pressure where little coolant is needed compared with the situation when the receiving tanks are virtually full and the volume of gas is not discharged until the end of the compression stroke. As shown in FIG. 13D, the volume of gas being compressed is discharged through the check valve and backpressure from the receiving tanks equals the pressure of the discharged gas. As shown in FIG. 13E, the pistons are at top dead center and the discharge has ended, the remaining volume V 4 of gas is expanded to the volume V 5 as shown in FIG. 13A. A comparison of the phase diagram of FIGS. 13A–13E shows a correspondence between the volume indications and the V points on the pressure volume diagram.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A high pressure gas compressor unit adapted for use in combination with a high pressure gas storage receiver having gas stored under high pressure, and with a liquified gas storage receiver having gas stored in liquified form, the compressor unit comprising:

a housing containing a high pressure gas compression cylinder with a high pressure displacement piston reciprocal in the gas cylinder, the gas cylinder and displacement piston forming in part a gas compression chamber;

a gas supply passage in the housing connectable to a gas supply from a supply source of gas to be compressed, the gas supply passage periodically communicating with the gas compression chamber, wherein the gas supply delivers a charge of supply gas to the compression chamber for compression on displacement of the piston during a compression phase of the operating cycle of the compressor unit;

a liquified gas supply passage in the housing communicating with the compression chamber and communicating with a liquified gas supply having gas stored in liquified form;

a liquid coolant injector connected to the liquified gas supply passage, the injector having an injector nozzle communicating with the gas compression chamber, the liquid coolant injector being electronically actuated;

a liquid pump means in the liquified gas supply passage between the fuel injector and the liquified gas supply, for pressurizing liquified gas supplied to the liquid coolant injector for pressurized injection into the compression chamber at any time during the compression phase of an operating cycle of the compressor unit;

liquified gas regulation means for regulating a pulse of liquified gas injected into the compression chamber for mixing with the charge of supply gas during compression, wherein the liquified gas regulation means includes electronic control means for controlling the timing and duration of the pulse of liquified gas injected into the compression chamber to occur at any time during the compression phase of the operating cycle of the compressor unit for optimized cooling;

a compressed gas discharge passage in the housing communicating with the compression chamber and communicating with the high pressure gas storage receiver; and, compressed gas regulation means for regulating the discharge of compressed gas from the compression chamber to the high pressure gas storage receiver, wherein the electronic control means comprises an electronic control module and the liquid coolant injector is electronically controlled by the electronic control module, wherein the electronic control module monitors the temperature of compressed gas discharged from the compression chamber and controls the timing and duration of the pulse of liquified gas injected into the compression chamber to occur at an optimized time during the compression phase.

2. The high pressure gas compressor unit of claim 1 wherein the compressed gas regulation means includes a check valve in the gas discharge passage.

3. The high pressure gas compressor unit of claim 1 wherein the piston has a compression stroke and a maximum displacement on the compression stroke and the gas compression chamber has a reduced volume when the piston is at maximum displacement on the compression stroke with the compression chamber retaining a residual volume of compressed gas, and wherein the piston has an expansion stroke with the residual volume of compressed gas expanding in the expansion stroke to mix with the charge of supply gas and reduce the temperature of a resulting gas mixture in the compression chamber.

4. The high pressure gas compressor unit of claim 3 wherein the compression chamber has volumetric adjustment means for adjusting the volume of the residual volume of the compression chamber.

5. The high pressure gas compressor unit of claim 1 wherein the high pressure gas storage receiver is connected to the liquified gas storage receiver comprising a conduit that includes an expander means for transforming compressed gas in the high pressure gas storage receiver to liquified gas in the liquified gas storage receiver.

* * * * *